United States Patent [19]

Geist

[11] Patent Number: 4,774,863

[45] Date of Patent: Oct. 4, 1988

[54] FASTENER FEEDER AND DRIVER APPARATUS

[75] Inventor: Bernard W. Geist, Melrose Park, Ill.

[73] Assignee: Duo-Fast Corporation, Franklin Park, Ill.

[21] Appl. No.: 918,594

[22] Filed: Oct. 10, 1986

Related U.S. Application Data

[63] Continuation of Ser. No. 733,492, May 13, 1985, abandoned.

[51] Int. Cl.[4] ..... B25B 23/04

[52] U.S. Cl. ..... 81/434; 81/433; 81/435

[58] Field of Search ..... 81/429–435, 81/57.37; 227/136; 221/29, 71, 74

[56] References Cited

U.S. PATENT DOCUMENTS

| | | | |
|---|---|---|---|
| 3,563,438 | 2/1971 | Doyle | 227/136 X |
| 3,837,556 | 9/1974 | Doyle et al. | 227/136 |
| 3,910,324 | 10/1975 | Nasiatka | 81/434 |
| 3,930,297 | 1/1976 | Potucek et al. | 81/434 X |
| 3,971,421 | 7/1976 | Damratowski | 81/434 |
| 4,003,417 | 1/1977 | Cornwell | 81/57.37 |
| 4,014,488 | 3/1977 | Potucek et al. | 227/136 X |
| 4,030,383 | 6/1977 | Wagner | 81/429 X |
| 4,428,261 | 1/1984 | Takatsu et al. | 81/434 |

*Primary Examiner*—Debra Meislin
*Attorney, Agent, or Firm*—Mason, Kolehmainen, Rathburn & Wyss

[57] ABSTRACT

A pneumatically operated and controlled fastener feeder and driver apparatus supplies individual fasteners, such as screws having a head and a threaded shank portion, which are maintained on a carrier strip in a magazine assembly, to a nose assembly of the fastener feeder and driver apparatus. When a fastener is positioned in the nose assembly, a driver member of a power fastener driving tool engages the fastener and positions the fastener such that the fastener extends out from a workpiece engaging surface of the nose assembly. When the fastener is driven into the workpiece to a specified depth, a pneumatically operated and controlled driver mechanism moves the fastener driving tool away from the workpiece. Thereafter, the fastener strip is incrementally advanced by a pneumatically operated feeding mechanism so that a next one of the individual fasteners on the strip is positioned within the nose assembly and the driver mechanism moves the fastener driving tool toward the fastener so that the fastener is removed from the fastener strip, positioned so as to be extending out from the workpiece engaging surface and ready for driving into the workpiece.

14 Claims, 7 Drawing Sheets

FIG. 1
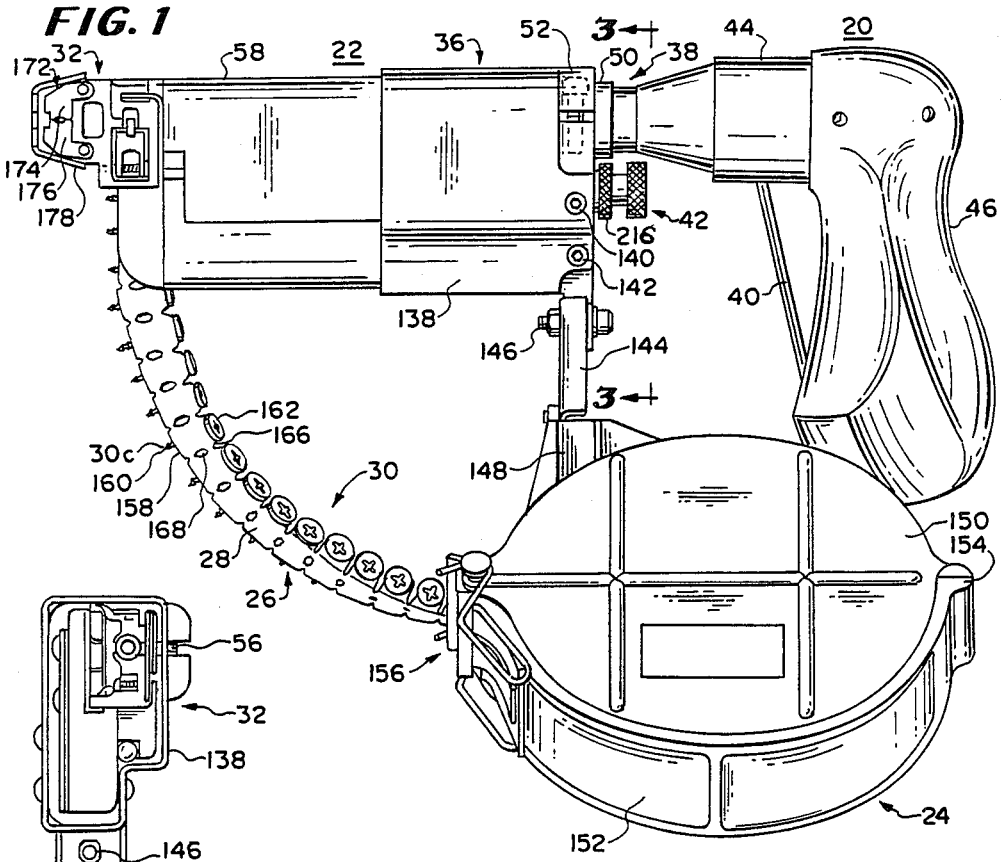
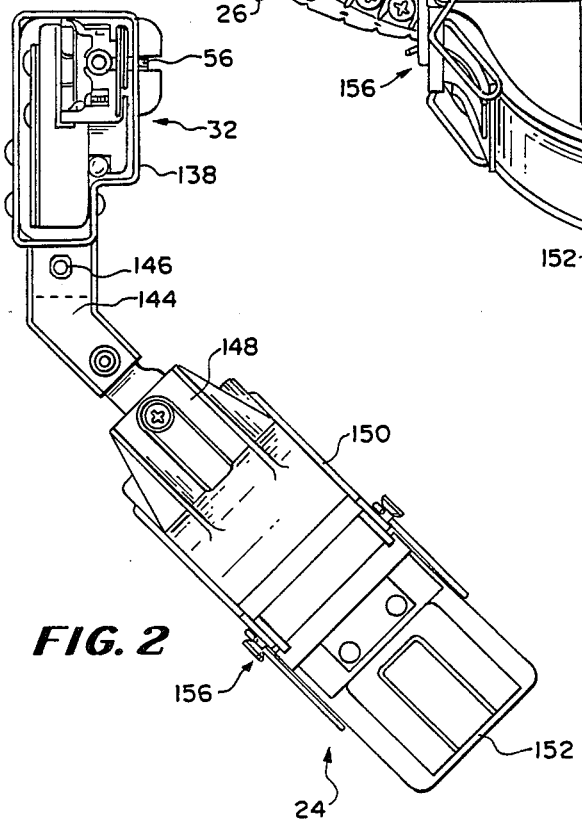
FIG. 2
FIG. 3
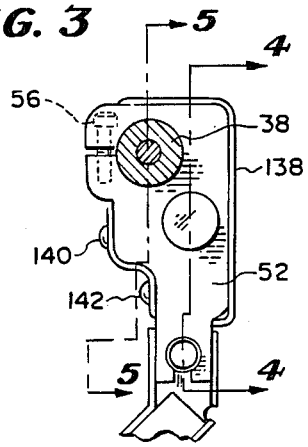

FASTENER FEEDER AND DRIVER APPARATUS

This application is a continuation, application Ser. No. 06/733,492, filed May 13, 1985, now abandoned.

BACKGROUND OF THE INVENTION

A. Field of the Invention

The present invention relates to a fastener feeder and driver apparatus for use with a fastener driving tool, and more particularly, to a new and improved pneumatically operated feeder and driver assembly for manipulating rotary entry fasteners, such as screws, which are to be driven into a workpiece.

B. Description of the Prior Art

Power tools are used in a number of applications for driving threaded or rotary entry fasteners into a workpiece. For example, drywall panels, metal panels or the like have to be affixed to wood or metal studs or other support elements in constructing internal walls of a building. Rotary entry fasteners, such as screws, can be used to affix such panels to the support elements by driving the fasteners through the panels into the support elements. In many applications, a power screwdriver is used for driving the screws through the panels and into the support elements. These screwdrivers may be electrically or pneumatically powered. In either case, the power screwdriver may include a housing with an integral handle and a rotary driving bit extending from the housing. In a conventional fastener driving operation, the bit is adapted to be mated with a slot structure in the head of the fastener to be driven. As the screwdriver is moved toward the workpiece, the end of the bit becomes disposed in the slot structure of the screw and the screw is rotated and driven into the workpiece. In order to position the fasteners for driving by the bit of the screwdriver, individual fasteners may be manually placed against the workpiece and held there until the screwdriver bit engages the fastener and the screw begins its penetration into the workpiece. Alternatively, the fastener might be held against the bit by having the driver bit magnetized. Manual handling of individual fasteners in this manner is slow, inconvenient and undesirable.

The assignee of record of the present application has developed fastener feeding and driving apparatus to feed and properly position individual fasteners so that they can be driven into a workpiece by a power screwdriver. Two such devices are disclosed in U.S. Pat. Nos. 3,910,324 and 3,930,297. The feeder mechanism disclosed in those patents are of the mechanical type that advance a flexible strip or carrier of fasteners from a housing containing a coiled strip of fasteners. These feeder mechanisms rely on the force exerted by the operator during the driving stroke to feed the fasteners and the fasteners which are to be driven do not extend out from the workpiece engaging surface of the nose assembly so that it is difficult to precisely locate the fastener vis-a-vis the location, such as a predrilled hole, on the workpiece where the fastener is to be inserted.

SUMMARY OF THE INVENTION

Accordingly, objects of the present invention are to provide a new and improved fastener feeder and driver apparatus; to provide a new and improved fastener feeder and driver apparatus which includes a pneumatically operated feeder and driver assembly; to provide a new and improved fastener feeder and driver assembly for use with a power screwdriver so that the fasteners can be positioned for driving into a workpiece by the power screwdriver; to provide a new and improved fastener feeder and driver apparatus in which a pneumatically operated fastener feeder and driver assembly feeds individual fasteners from a strip of fasteners into proper position so that a power screwdriver can drive the fastener into a workpiece; to provide a new and improved fastener feeder and driver apparatus in which the fastener to be driven into a workpiece extends outwardly from the nosepiece of the apparatus so that it an be precisely positioned vis-a-vis the location in the workpiece where the fastener is to be driven; to provide a new and improved fastener feeder and driver apparatus which can be adjusted to set the depth to which the fastener is to be driven into a workpiece; and to provide a new and improved fastener feeder and driver apparatus which is generally compact and light in weight.

In accordance with these and many other objects of the present invention, an embodiment of the present invention comprises a pneumatically controlled and operated fastener feeder and driver apparatus for supplying and positioning fasteners, such as screws having a head and a threaded shank portion, so that the fasteners can be driven into a workpiece by the power screwdriver. A supply of fasteners in strip form is maintained in a magazine assembly and individual fasteners are fed into a nose assembly of the fastener feeder and driver apparatus. When a fastener is positioned in the nose assembly, a portion of the threaded shank of the fastener projects from the nose assembly so that it can be properly positioned with respect to the workpiece into which the fastener is to be driven. Upon actuation of the power screwdriver, a bit which engages the fastener to be driven pushes and rotates the fastener thereby forcing it into the workpiece. Once the fastener has been inserted into the workpiece to a proper depth, pneumatically controlled mechanisms of the feeder and driver apparatus moves the fastener driving tool and thereby the bit away from the workpiece during a fire mode and a first portion of a return mode of the feeder and driver assembly. During a second portion of the return mode, the fastener strip is incrementally advanced by a pneumatically controlled feed mechanism so that a next one of the fasteners on the strip is positioned within the nose assembly. Thereafter the feeder and driver mechanism moves the fastener driving tool with the bit toward the fastener so that the fastener is removed from the fastener strip and positioned so as to extend out from the nose assembly for driving into the workpiece.

BRIEF DESCRIPTION OF THE DRAWINGS

Many other objects and advantages of the present invention will become apparent from considering the following detailed description in conjunction with the drawings in which:

FIG. 1 is a side view of a fastener feeder and driver apparatus embodying the present invention;

FIG. 2 is a front view of the fastener feeder and driving apparatus of FIG. 1;

FIG. 3 is a sectional view taken along line 3—3 of FIG. 1;

DESCRIPTION OF THE PREFERRED EMBODIMENT

Figure 4:
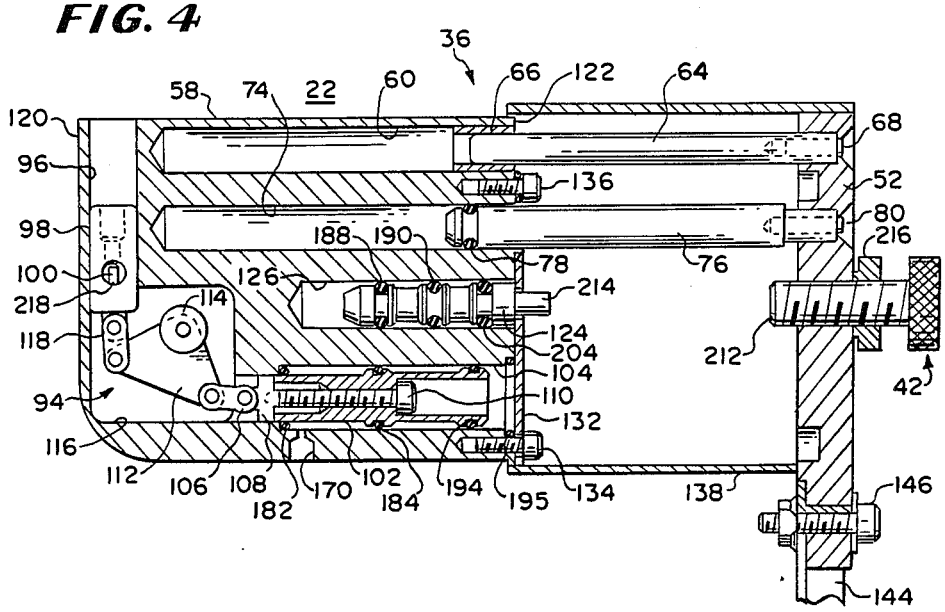
FIG. 4 is a sectional view taken along line 4—4 of FIG. 3.

Referring now more specifically to the drawings, therein is disclosed a fastener driving tool 20 having attached thereto a feeder and driver assembly which is generally designated as 22 and which embodies the present invention. The feeder and driver assembly 22 includes a magazine assembly 24 in which is housed a fastener strip 26 comprised of a carrier member 28 and a plurality of fasteners 30. The fastener strip 26 is fed into a nose assembly 32 of the feeder and driver assembly 22 wherein one of the fasteners 30, such as a fastener 30*a* (FIG. 6), is positioned so that it can be driven into a workpiece (not shown), such as a wall panel or the like. The fastener 30*a* is driven into the workpiece by a driver member or bit 34 which is rotated by the fastener driving tool 20. A pneumatically operated feeder and driver mechanism 36 forming a part of the feeder and driver assembly 22 is attached to a front end 38 of the fastener driving tool 20 and has the nose assembly 32 mounted thereon.

Figure 6:
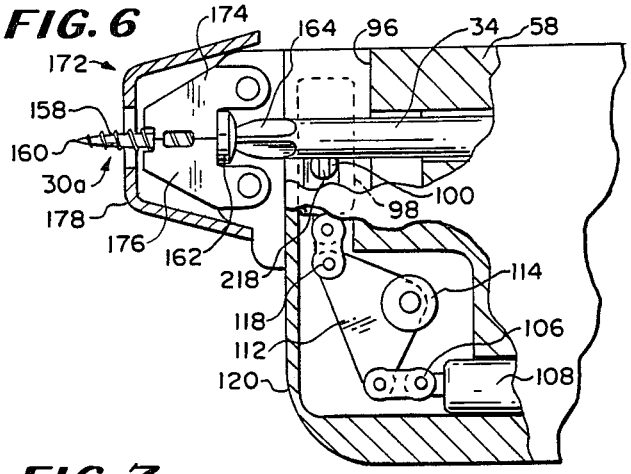
FIG. 6 is a partial sectional view of the fastener feeder and driver apparatus of FIG. 1 illustrating the apparatus in its static or ready mode.
Figure 7:
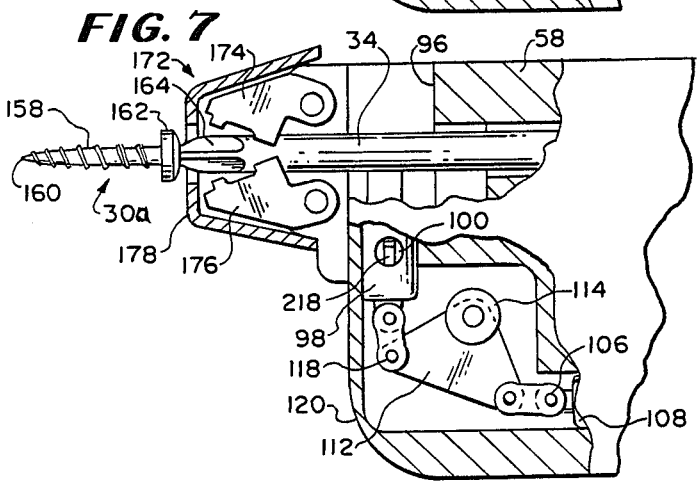
FIG. 7 is a partial sectional view of the fastener feeder and driver apparatus of FIG. 1 illustrating the apparatus when a screw is being driven into a workpiece.
Figure 8:
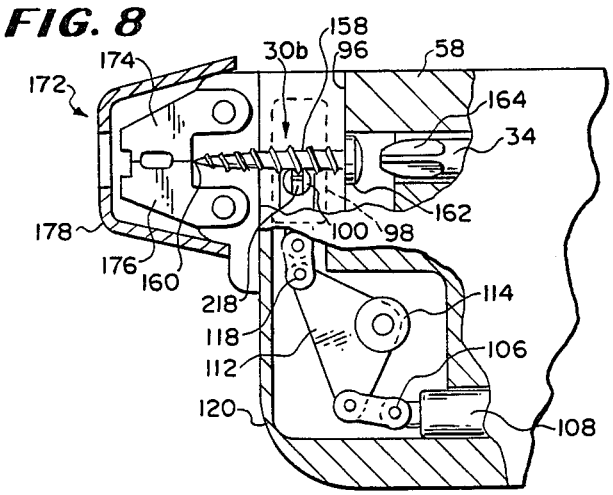
FIG. 8 is a partial sectional view of the fastener feeder and driver apparatus of FIG. 1 illustrating the apparatus when another screw is being incrementally advanced into the nose assembly of the fastener feeder and driver apparatus.

As will be described in more detail hereinafter, the feeder and driver assembly 22 is normally in a standby or static mode as illustrated in FIG. 6 of the drawings with a fastener 30*a* disposed in and projecting from the nose assembly 32 so as to be in a position to be driven into a workpiece. Upon the actuation of a trigger 40 of the fastener tool driving 20, the bit 34 is rotated and an operator of the tool 20 pushes the fastener driving tool 20 towards the workpiece so that the fastener 30*a* is forced to the left as illustrated in FIG. 7 of the drawings and is driven into a workpiece. Once the fastener 30*a* is inserted into the workpiece to a proper depth as determined by an adjustable stop screw 42, the feeder and driver mechanism 36 moves the fastener driving tool 20 and thereby the bit 34 to the right as viewed in FIG. 1 during a fire mode and a first portion of a return mode of the feeder and driver assembly 22. As a result, the bit 34 is returned to the position illustrated in FIG. 8 of the drawings. During a second portion of the return mode, the fastener strip 26 is incrementally advanced so that the next one of the fasteners 30, such as fastener 30*b*, is positioned in the nose assembly 32 as illustrated in FIG. 8 of the drawings. Thereafter, the feeder and driver mechanism 36 moves the fastener driving tool 20 and thereby the bit 34 toward the fastener 30*b* whereby the fastener 30*b* is removed from the fastener strip 26 and advanced to a position illustrated in FIG. 6 with respect to the fastener 30*a*. The feeder and driver assembly 22 is again in its static or ready mode so that the fastener 30*b* can be driven into a workpiece.

The fastener driving tool 20 shown in FIG. 1 is a pnuematic power screwdriver and is adapted to drive fasteners, such as the fasteners 30, which in the disclosed embodiment are screws, into drywall panels and the metal or wood studs onto which such panels are mounted. The fastener driving tool 20 includes a housing 44 from which extends a handle portion 46. Air from a pressurized source of air, such as a compressor, is supplied to a pnuematically operated motor (not shown) located in the housing 44 and enables the motor to provide a rotary motion to a bit holder 48 through a clutch 50 when the trigger 40 is depressed. While the disclosed fastener driving tool 20 is pnuematically operated, standard electric screwdrivers can be used as the driving tool in the same manner as the disclosed pnuematically operated screwdriver 20.

The front portion 38 of the fastener driving tool 20 is secured to a mounting block 52 forming a part of the feeder and driver mechanism 36, which mounting block 52 has an opening 54 into which the front end 38 of the fastener driving tool 20 can be positioned. Upon being so positioned, a retaining screw 56 compresses the opening 54 so as to hold the front end 38 of the fastener driving tool 20 in the opening 54.

The feeder and driver mechanism 36 also has a cylinder housing 58 in which is disposed pnuematic circuitry for controlling the operation of the feeder and driver assembly 22. As can be best seen in FIGS. 4 and 5 of the drawings, the cylinder housing 58 includes guide cylinders 60 and 62. A guide rod 64 is movably mounted within the cylinder 60 by a bearing 66 and is attached to the mounting block 52 by a screw 68. Another guide rod 70 is mounted to the mounting block 52 by a screw 72 and moves within the cylinder 62 in the cylinder housing 58. The guide rods 64 and 70 aid in guiding the mounting block 52 as it moves relative to the cylinder housing 58 during the operation of the feeder and driver mechanism 36.

The cylinder housing 58 also includes an extend cylinder 74 in which is movably mounted an extend piston 76 having an O-ring 78 to seal a portion of the cylinder 74. The extend piston 76 is also secured to the mounting block 52 by a screw 80. During the fire mode and a portion of the return mode, the extend piston 76 causes the mounting block 52 to move to the position shown in FIGS. 4 and 5.

The feeder and driver mechanism 36 includes a retract rod 82 which is secured to the mounting block 52 by a screw 84. A retract piston 86 is movably mounted about the retract rod 82 and a piston seal 88 forms a seal about the rod 82. A fastener 90 attached to the end of the retract rod 82 forces the retract piston 86 to move to the right as viewed in FIG. 5 as the retract rod 82 moves in that direction. The retract piston 86 travels within a retract cylinder 92 within the cylinder housing 58. The retract rod 82 pulls the mounting block 52 to its static position during the second portion of the return mode.

A fastener strip feeder mechanism 94 is disposed within the cylinder housing 58. The feeder mechanism 94 includes a pawl cylinder 96 which extends vertically in the cylinder housing 58 and in which is movably mounted a pawl piston 98. A feed pawl 100 is mounted within the pawl piston 98. The movement of the piston 98 within the pawl cylinder 96 is controlled by a feed piston 102 which is movably mounted within a feed cylinder 104. A chain link 106 is secured to the feed piston 102 by a feed pin 108 and a fastener 110. The chain link 106 is attached to a feed pivot plate 112 which pivots on a pivot 114 within a cavity 116 in the cylinder housing 58. The pivot plate 112 is attached to the pawl piston 98 by another chain link 118. Since the feed piston 102 is secured to the pawl piston 98 by means of the chain links 106 and 118 and the pivot plate 112, movement of the piston 102 from left to right in FIG. 4 translates into an up and down motion of the piston 98 within the feed cylinder 96. As a result, the cylinder housing 58 occupies a minimum amount of space between its front end 120 and its rear end 122 such that the entire length of the feeder and driver assembly 22 is minimized.

The cylinder housing 58 also houses a stop valve 124 disposed within a stop valve cylinder 126. The stop valve 124 is actuated by the stop screw 42 and controls the extent to which the mounting block 52 moves towards the front end 120 of the cylinder housing 58 while one of the fasteners 30 is being driven into a workpiece.

Figure 5:
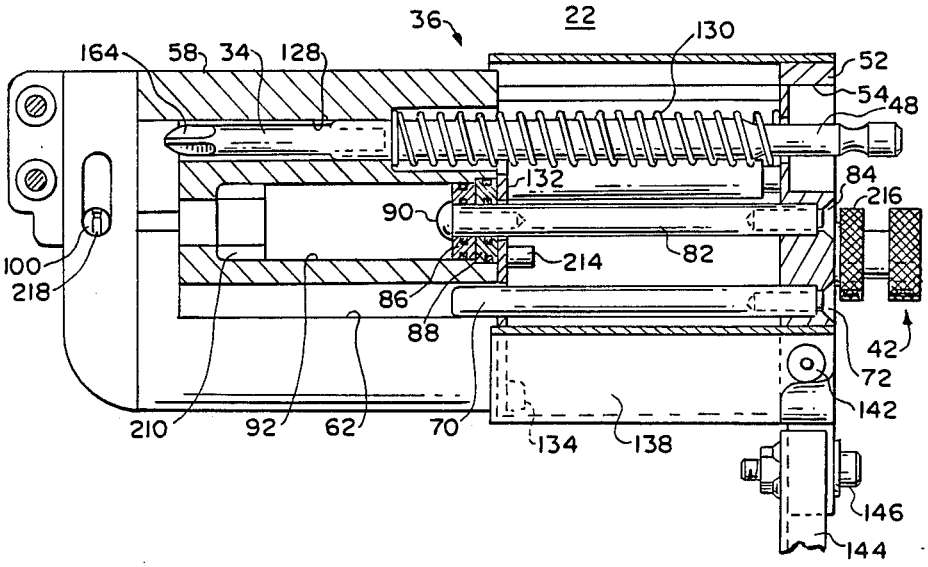
FIG. 5 is a sectional view taken along line 5—5 of FIG. 3.

The cylinder housing 58 in addition has a channel 128 through which the driver bit 34 extends (FIG. 5). The driver bit 34 is held in the bit holder 48. A spring 130 is disposed about the bit holder 48 between the cylinder housing 58 and the mounting block 52. The spring 130 is compressed as the mounting block 52 is moved towards the front end 120 of the cylinder housing 58 during the installation of one of the fasteners 30 and assists in returning the mounting block 52 to the position shown in FIGS. 4 and 5 of the drawings during the fire mode and the first portion of the return mode.

A cover plate 132 is secured to the rear end 122 of the cylinder housing 58 by fasteners 134 and 136. In order that personnel are not exposed during the operation of the fastener feeder and driver assembly 22 to the rods 64 and 70, the pistons 82 and 76 and the bit holder 48, the feeder and driver assembly 22 includes a guard 138 which is attached to the mounting block 52 by screws 140 and 142 and moves about the cylinder housing 58 when the mounting block 52 moves relative to the cylinder housing 58 during the operation of the feeder and driver assembly 22.

The magazine assembly 24 is maintained relative to the driving tool 20 by securing it to the mounting block 52 by means of a downwardly projecting leg 144 which is secured to the mounting block 52 by a fastener 146. The leg 144 is attached to a socket 148 projecting from a housing 150 of the magazine assembly 24. The housing 150 preferably is formed of a relatively lightweight, yet strong material such as a suitable plastic or the like. The housing 150 is generally circular in outline so that it can receive the fastener strip 26 when it is rolled into a coil. In this connection, a lower peripheral wall 152 of the housing 150 may be swung about a hinge 154 and is latched in a closed position by a latch assembly 156. When the latch 156 is released, the door 152 can be swung about the hinge 154 so that the inner part of the housing 150 is accessible and can be filled with a coiled fastener strip 26. When the door 152 is again secured in its closed position as shown in FIG. 1 of the drawings, a portion of the fastener strip 26 is fed out of the housing 150 to the nose assembly 32. The portion of the fastener strip 26 extending between the housing 150 and the nose assembly 32 is twisted through a substantial angle so that there is no interference between the fastener strip 26 and a workpiece and the fastener strip 26 can flex as the driving tool 20 and the magazine assembly 24 moves relative to the nose assembly 32.

As illustrated in connection with fasteners **30*a*, 30*b* and 30*c*, each fastener 30 includes a shank portion 158, at least a portion of which is threaded, a tip 160 at the entry end of the shank portion 158 and a head 162 at the opposite end of the shank 158. The head 162 is provided with a drive slot structure which is complementary to a tip portion 164 of the driver bit 34. When the tip portion 164 of the bit 34 is inserted into the complementary drive slot of the head 162, the rotation of the driver bit 34 causes the fastener 30** to be rotated in accordance with known practices.

The fastener strip 26 is of the type disclosed in U.S. Pat. No. 3,885,669, assigned to the assignee of record of the present application. The fastener strip 26 includes the carrier member 28 which is in the form of an elongated strip of flexible plastic material. The carrier member 28 is continuous throughout the length of the fastener strip 26 and, as illustrated in connection with the fastener **30*c* in FIG. 1, includes a tab 166 which extends from one side of the carrier strip 28 and which is designed to receive the fastener 30*c* in a slot located in the tab 166 such that the fastener 30*c* is frictionally retained therein with the shank portion 158 of the fastener 30*c* extending generally parallel to the plane of the carrier member 28. The fastener strip 26 can be provided with a tab extending from the other end of the carrier member 28 in order that the fasteners 30 are more securely affixed to the fastener strip 26. The carrier member 28 also is provided with a series of openings 168, one of which openings is longitudinally placed along the carrier member 28 between each of the tabs 166. The openings 168 are adapted to receive the feed pawl 100 in order for the fastener strip 26 to be incrementally advanced during the operation of the feeder and driver assembly 22**.

As previously indicated, the feeder and driver mechanism 36 which forms a part of the feeder and driver assembly 22 is a pneumatically operated mechanism. Pressurized air from an air reservoir, such as a compressor or the like, is supplied to a port 170 on the lower portion of the cylinder housing 58 via an appropriate hose or the like (not shown). The operation of the pneumatically operated feeder and driver mechanism 36 will become more apparent with reference to FIGS. 9–12 which disclose in schematic form the pneumatic circuitry for the feeder and driver mechanism 36 during various modes or phases of the operation of the feeder and driver assembly 22.

Figure 9:
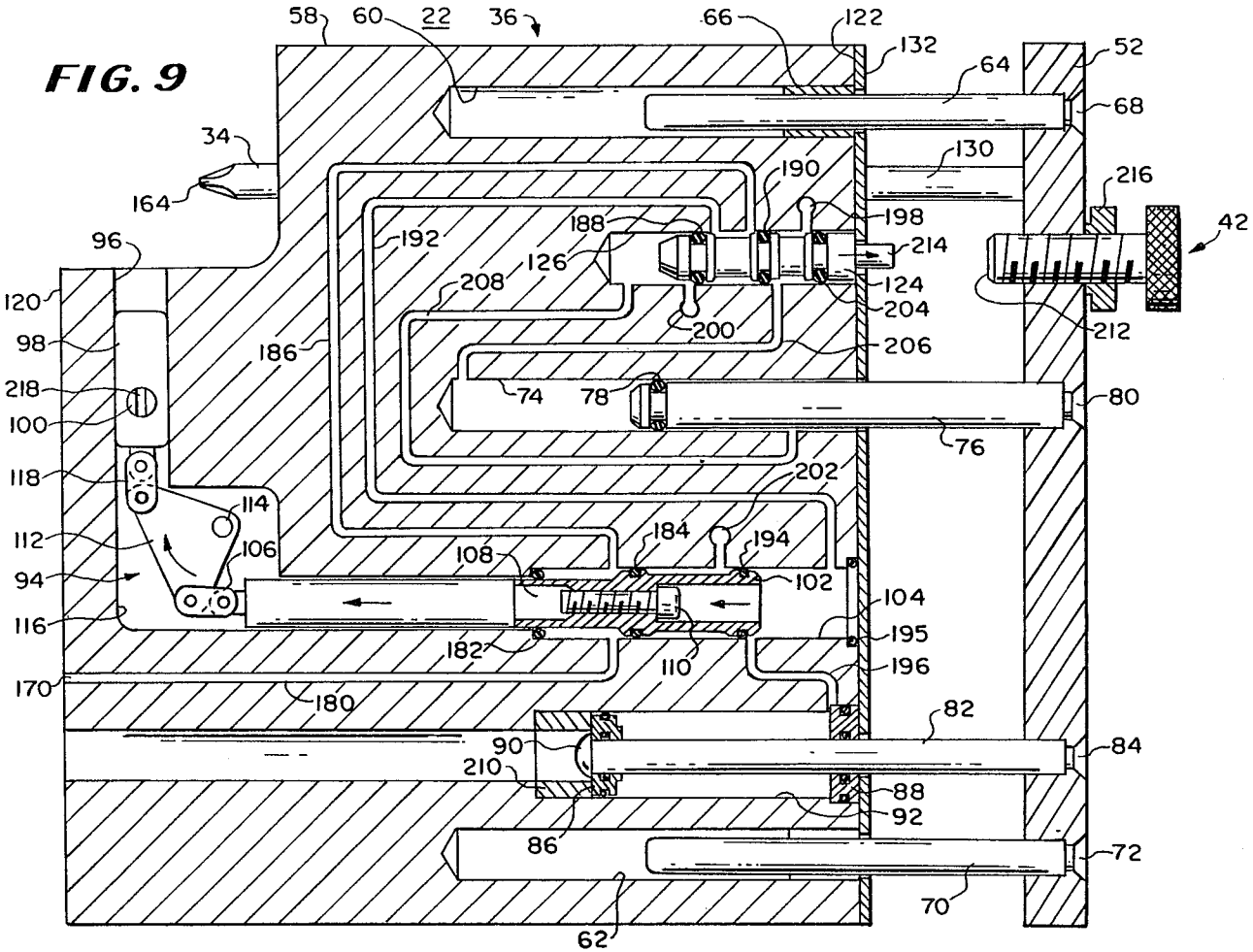
FIG. 9 is a schematic diagram of the air circuitry for the feeder and driver mechanism portion of the fastener feeder and driver apparatus of FIG. 1 in the static or ready mode of the fastener feeder and driver apparatus.

More specifically, and with reference to FIG. 9 of the drawings, the feeder and driver assembly 22 is shown therein in its static or ready mode so that one of the fasteners, such as the fastener **30*a* shown in FIG. 6, is ready for being driven into a workpiece. In this regard, the fastener 30*a* is held in a nose chuck 172 consisting of jaws 174 and 176. The jaws 174 and 176 are biased to hold the fastener 30***a* as shown in FIG. 6 so that the fastener 30*a* has a portion of its shank 158 extending out from a nose guard 178. When the feeder and driver assembly 22 is in the static mode disclosed in FIGS. 6 and 9 of the drawings, the bit 34 has its tip portion 164 inserted into the head 162 of the fastener 30*a*. Advantageously, since the top 160 of the fastener 30*a* extends out from the workpiece engaging surface of the nose guard 178 prior to being driven into a workpiece, the fastener 30*a* may be positioned within a pilot hole in the workpiece into which it is to be driven or against the workpiece, if no pilot hole is formed therein, prior to the fastener 30*a* being rotated and driven by the bit 34. It is noted that when the fastener 30*a* has been positioned as shown in FIG. 6, the fastener 30*a* has been removed from the fastener strip 26 as will be discussed in more detail below.

When the feeder and driven assembly 22 is in its static mode as illustrated schematically in FIG. 9, reservoir air (i.e., pressurized air) is supplied through an air duct 180 to the portion of the cylinder 104 between an O-ring 182 sealing the cylinder 104 and O-ring 184 on the feed piston 102. The reservoir air is also supplied through a duct 186 to the portion of the cylinder 126 between O-rings 188 and 190 on the stop valve 124 and from there through another duct 192 to the portion of the feed cylinder 104 between an O-ring 194 on the feed piston 102 and an O-ring 195 which seals the cylinder 104 along the cover plate 132. That portion of the feed cylinder 104 is connected via a duct 196 to the retract cylinder 92 so that reservoir air is supplied to the retract cylinder 92 between the piston seal 88 and the retract piston 86.

Air vents 198, 200, and 202 are provided in the cylinder housing 58 to connect various portions of the pneumatic circuitry to atmosphere. In the static mode illustrated in FIG. 9, the air vent 198 vents that portion of the stop valve cylinder 126 between the O-ring 190 and an O-ring 204 to atmosphere. Since that portion of the stop valve cylinder 126 between the O-rings 190 and 204 is connected to the extend cylinder 74 by a duct 206, the portion of the extend cylinder 74 to the left, as viewed in FIG. 9, of the O-ring 78 on the extend piston 76 is at atmospheric pressure. The air vent 200 connects the portion of the stop valve cylinder 126 to the left, as viewed in FIG. 9, of the O-ring 188 to atmosphere. A duct 208 connects that portion of the stop valve cylinder 126 and therefore the vent 200 to the portion of the extend cylinder 74 to the right of the O-ring 78. Consequently, the entire extend piston cylinder 74 is at atmospheric pressure. The air vent 202 is coupled to the feed piston cylinder 104 between the O-rings 184 and 194 resulting in that portion of the piston cylinder 104 being maintained at atmospheric pressure.

In the static mode, the retract rod 82 positions the mounting block 52 as illustrated in FIG. 9 of the drawings due to the fact that reservoir air supplied to the cylinder 92 forces the retract piston 86 against a spacer 210. In addition, the feed piston 102 positions the pawl piston 98 and consequently the feed pawl 100 in the position shown in FIG. 9 such that one of the fasteners 30 will be in alignment with the driver bit 34. The feed piston 102 is placed in this position due to the fact that reservoir air supplied to the larger diameter of the feed piston 102 between the O-rings 194 and 195 overcomes the force exerted by the reservoir air that is supplied to the smaller diameter portion of the feed piston 102 between the O-rings 182 and 184. Since the entire extend cylinder 74 is vented to atmosphere, the extend piston 76 is allowed to move within the cylinder 74 as the mounting block 52 is moved to the left in FIG. 9 by the retract piston 82. The stop valve 124 is in its ready mode as shown in FIG. 9 due to the presence of reservoir air between the O-rings 188 and 190.

When the feeder and driver assembly 22 is in its static mode, an operttor can drive a fastener, such as the fastener 30*a* shown in FIG. 6, into a workpiece. This is accomplished by the operator actuating the trigger 40 so that the fastener driver tool 20 rotates the bit holder 48 which in turn causes the driver bit 34 to rotate. The operator then pushes against the handle 46 of the fastener driving tool 22 causing the mounting block 52 to move toward the workpiece. This movement of the mounting block 52 forces the bit holder 48 and the bit 34 to push against the fastener 30*a* and the fastener 30*a* is thereby installed into the workpiece. During this process, the fastener 30*a* forces open the jaws 174 and 176 of the nose chuck 172 as illustrated in FIG. 7 of the drawings. Once the fastener 30*a* has been driven into the workpiece an appropriate distance, an end 212 of the stop screw 42 engages a stem 214 of the stop valve 124 projecting through the cover plate 132. As a result, the stop valve 24 is moved to the position shown in FIG. 10 of the drawings initiating what can be termed the fire mode of the feeder and driver assembly 22.

Figure 10:
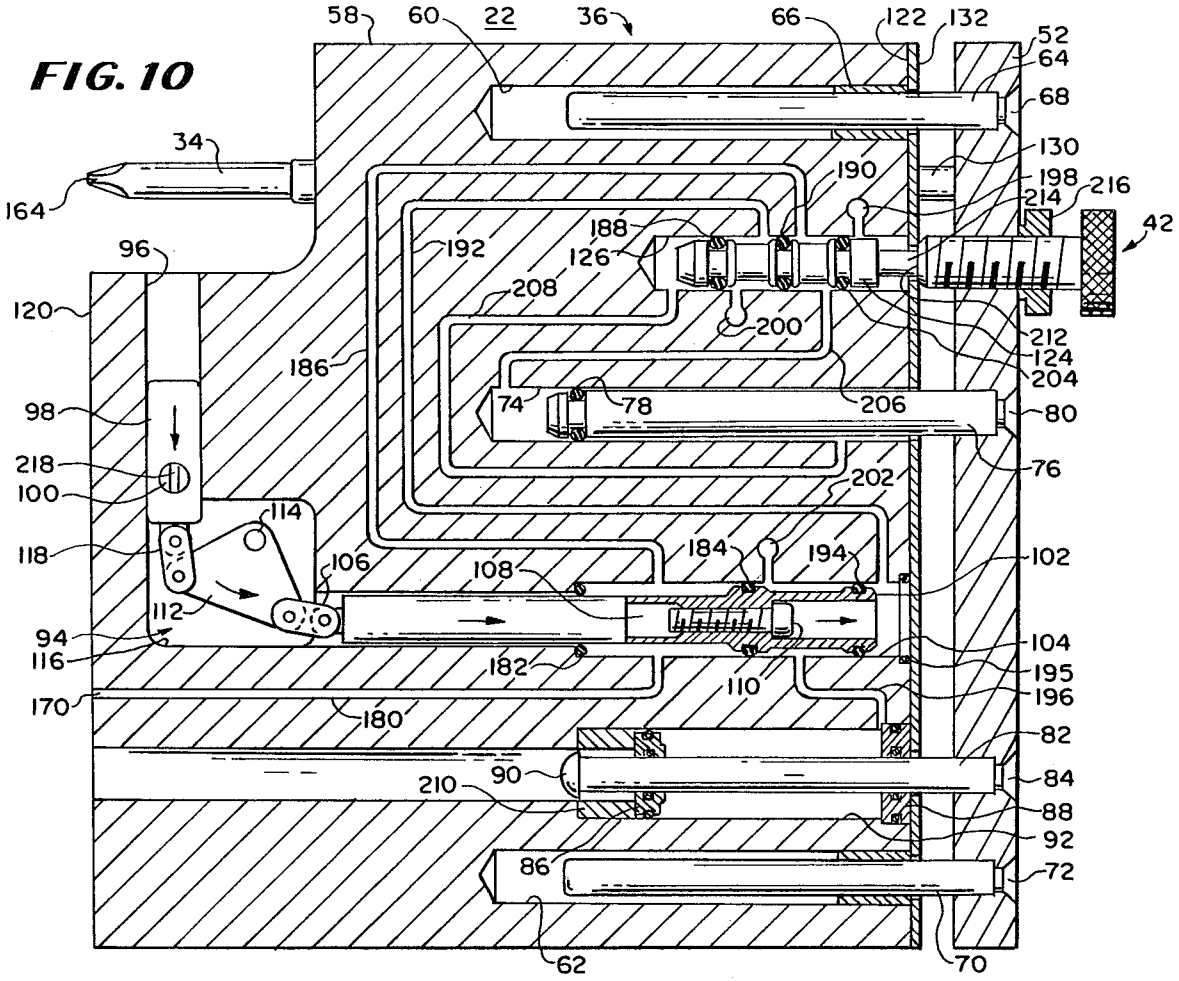
FIG. 10 is a schematic diagram of the air circuitry for the feeder and driver mechanism portion of the fastener feeder and driver apparatus of FIG. 1 in the fire mode of the feeder and driver apparatus.

The stop screw 42 can be adjusted relative to the mounting block 52 and locked in place by a lock nut 216. Consequently, the stop valve 124 acts as a depth control to determine the depth to which one of the fasteners 30 will be driven into a workpiece. More specifically, the location of the mounting block 52 when the fire mode is initiated as illustrated in FIG. 10 of the drawings determines the extent to which the bit 34 has driven a fastener, such as the fastener 30*a* in FIG. 7, out from the nose assembly 32 into a workpiece. If the stop screw 42 is adjusted so that the end 212 of the stop screw 42 is further to the left as viewed in FIG. 9, the end 212 will engage the stem 214 when the mounting block 52 is further to the right as viewed in FIG. 9. In this event, the fasteners 30 being driven into a workpiece will not be driven into the workpiece as deep as when the stop screw 42 is adjusted so that the tip 212 of the stop screw 42 is further to the right as viewed in FIG. 9.

When the stop valve 124 is moved towards the position shown in FIG. 10 of the drawing, the O-ring 188 passes the air vent 200 such that the duct 192 is vented to atmosphere resulting in the venting to atmosphere of the portion of the feed cylinder 104 between the O-ring 194 and the piston seal 195. Since reservoir air is still supplied through the duct 180 to the feed piston 104 between the O-rings 182 and 184, the feed piston 102 will move in the direction indicated by the arrows in FIG. 10 of the drawings. This movement of the feed piston 102 causes the feed pivot plate 112 to pivot about the pivot 114 pulling, via the chain link 118, the pawl piston 98 downwardly, as viewed in FIG. 10, in the feed cylinder 96. When the pawl piston 98 moves in this manner, the feed pawl 100 moves downwardly as viewed in FIGS. 1 and 10 along the carrier member 28 of the fastener strip 26 that is held against the feed pawl 100 in the nose assembly 32. However, since the feed pawl 100 has a cam surface 218 which permits the pawl 100 to slip past the opening 168 in the carrier member 28 when the feed piston 98 is moved as illustrated in FIG.

10, the feed pawl 100 does not move the fastener strip 26.

As the feed piston 102 moves to the right as viewed in FIG. 10, the O-ring 194 passes the air duct 196 so that the air duct 196 becomes vented to atmosphere because it is now connected to the air vent 202. Consequently, the retract cylinder 92 between the retract piston 86 and the piston seal 88 is placed at atmospheric pressure so that the retract piston 86 can be moved towards the piston seal 88. The movement of the stop valve 124 also results in the movement of the O-ring 190 past the duct 186 so that reservoir air is now supplied to the stop valve cylinder 126 between the O-rings 190 and 204. Reservoir air is also supplied via duct 206 to the extend cylinder 74 to the left of O-ring 78 as viewed in FIG. 10. Since the extend cylinder 74 to the right of the O-ring 78 is maintained at atmospheric pressure, via an opening in the cover plate 132 about the extend cylinder 74, the extend piston 76 is forced to the right as viewed in FIG. 10 of the drawings. The movement of the extend piston 76 in this manner forces the mounting block 52 to the right as viewed in FIG. 10. This movement of the mounting block 52 is guided by the guide rods 64 and 70.

Figure 11:
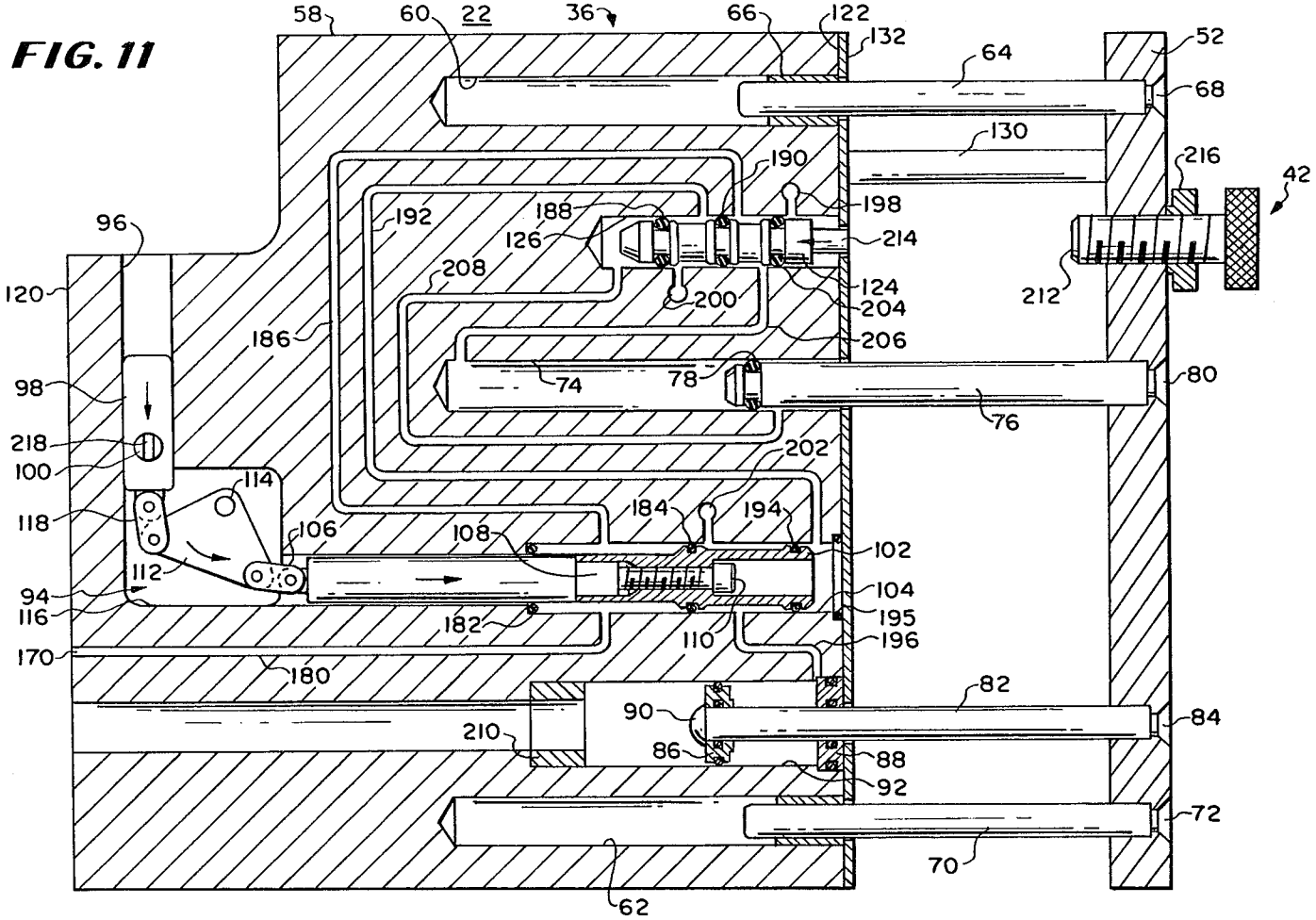
FIG. 11 is a schematic diagram of the air circuitry for the feeder and driver mechanism portion of the fastener feeder and driver apparatus for FIG. 1 during a first portion of the return mode of the fastener feeder and driver apparatus.

The mounting block 52 continues to move to the right. FIG. 11 of the drawings schematically illustrates the feeder and driver mechanism 36 at a point in time during what can be termed a first portion of the return mode of the feeder and driver assembly 22. During this portion of the return mode, reservoir air continues to be supplied to the extend cylinder 74 forcing the extend piston 76 further to the right as viewed in FIG. 11. As the mounting block 52 moves to the right as viewed in FIG. 11, the fastener 90 on the retract rod 82 engages the retract piston 86 and moves it away from the spacer 210 so as to move it toward the piston seal 88 as illustrated in FIG. 11 of the drawings. During this portion of the return mode of the feeder and driver assembly 22, the feed piston 102 is maintained in the position shown in FIG. 11 so that the feed pawl 100 is in its lowered position illustrated in FIG. 11 and is in alignment with the next one of the openings 168 in the carrier member 28 of the fastener strip 26 so that it will be in a position to incrementally advance the carrier member 28 when the feeder and driver assembly 22 enters the second portion of its return mode. The stop valve 124 remains in its depressed or actuated position due to the fact that reservoir air continues to be supplied to the stop valve cylinder 126 between O-rings 190 and 204 and the remaining portions of the stop valve cylinder 126 are maintained at atmospheric pressure. It is noted that at the point in time during the return mode illustrated in FIG. 11, the O-ring 78 on the extend piston 76 is still to the left of the duct 208. As the extend piston 76 is forced further to the right as viewed in FIG. 11, the O-ring 78 will move past the duct 208 resulting in the feeder and driver assembly 22 transferring into the second portion of its return mode.

Figure 12:
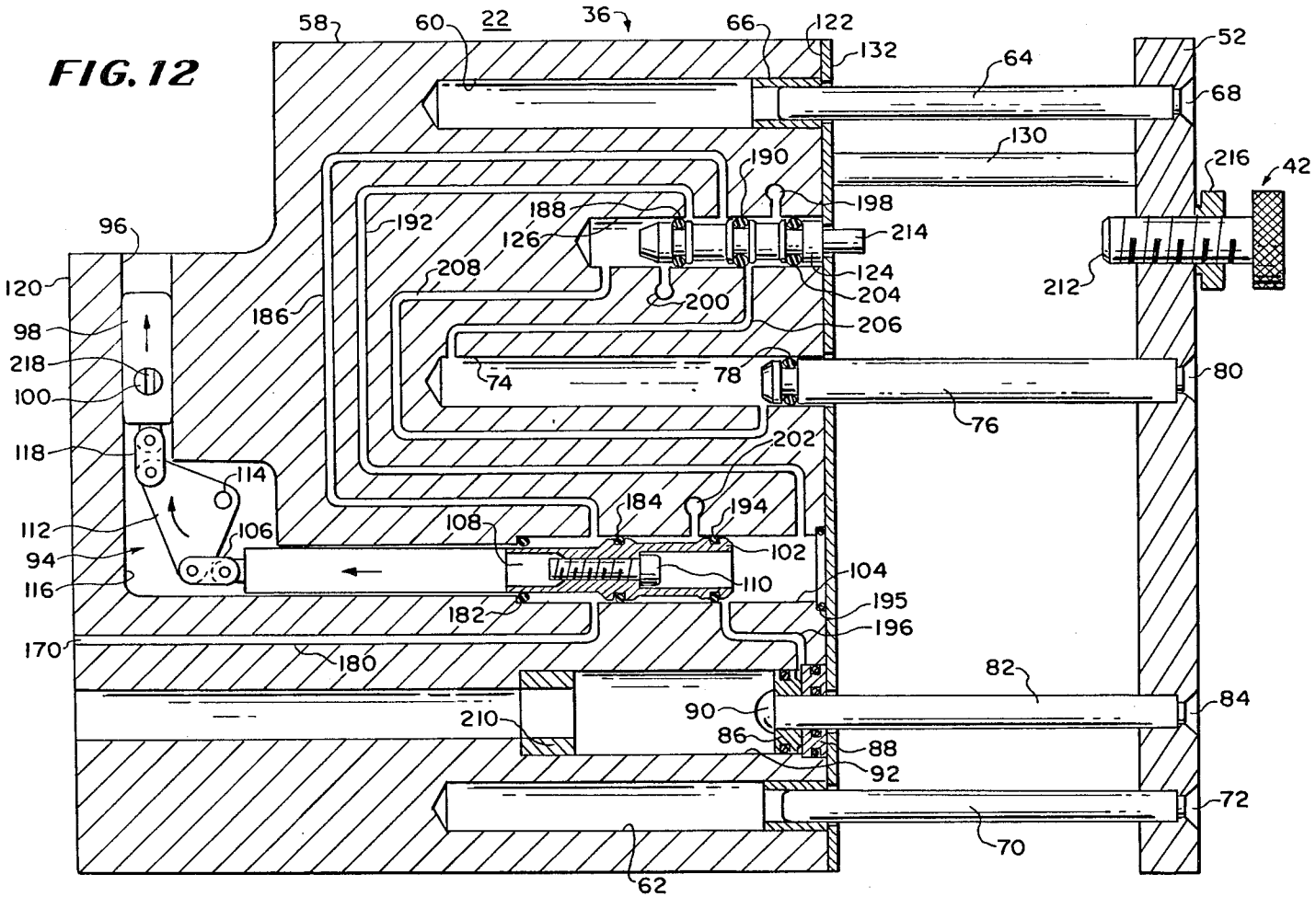
FIG. 12 is a schematic diagram of the air circuitry for the feeder and driver mechanism portion of the fastener feeder and driver apparatus of FIG. 1 during the second portion of the return mode of the fastener feeder and driver apparatus.

As the extend piston 76 moves to the right as viewed in FIGS. 11 and 12 of the drawings and the O-ring 78 passes the duct 208, reservoir air in the extend cylinder 74 is communicated via duct 208 to the portion of the stop valve cylinder 126 to the left of O-ring 188. The stop valve 124 is thereby forced toward the right in FIG. 12 to its ready position illustrated in FIG. 12. When the stop valve 124 has been so moved, the portion of the stop valve cylinder 126 to the left of O-ring 188 is vented to atmosphere because it is now in communication with the air vent 200. In addition, the portion of the extend cylinder 74 to the left of the O-ring 78 is also vented to atmosphere because it is coupled to the air vent 200 through the lefthand portion of the stop valve cylinder 126 and the duct 208. Since no reservoir air is supplied to the extend cylinder 74, the extend piston 76 will cease moving to the right as viewed in FIG. 12 such that the mounting block 52 no longer will be moved in that direction. At this point in time, the bit holder 130 has also been retracted to the right in FIG. 12 so that the bit 34 is positioned as illustrated in FIG. 8 of the drawings.

Once the stop valve 124 is returned to its ready position illustrated in FIG. 12, reservoir air that is being supplied via the duct 186 to the stop valve cylinder 126 between the O-ring 188 and 190 is now supplied to the duct 192 because the duct 186 is now in communication with the portion of the stop valve cylinder 126 between the O-rings 188 and 190. Consequently, reservoir air is supplied to the feed piston cylinder 104 between the O-rings 194 and 195. Since the feed piston 102 has a larger diameter in the area of the O-ring 194 as compared to the diameter of the feed piston between the O-rings 182 and 184, the feed piston 104 is forced to move to the left as viewed in FIG. 12 of the drawings. This results in the movement of the feed assembly 94 such that the pivot plate 112 is pivoted about the pivot 114 as shown by the arrow on the pivot plate 112 in FIG. 12. The feed piston 98 moves upwardly in the feed cylinder 96 so that feed pawl 100 also is moved upwardly in FIG. 12 to the position shown in FIG. 12. The movement of the feed pawl 100 in this manner results in the cam surface 218 engaging one of the openings 168 in the carrier member 28 of the fastener strip 26 and the fastener strip 26 is incrementally advanced upwardly as viewed in FIG. 1 of the drawings. The incremental advance of the fastener strip 26 in this manner results in the next one of the fasteners 30 to be positioned in alignment with the bit 34 as illustrated in FIG. 8 of the drawing.

As the feed piston 104 is moved in this manner, the O-ring 194 passes the duct 196 and reservoir air is supplied from the feed cylinder 104 through the duct 196 to the retract cylinder 92 between the retract piston 86 and the piston seal 88. The supplying of reservoir air to the retract cylinder 92 in this manner forces the retract piston 86 to move to the left as viewed in FIG. 12 and the retract piston 86 engages the fastener 90 forcing the retract rod 82 to also move towards the left as viewed in FIG. 12 of the drawing. Movement of the retract rod 82 forces the mounting block 52 to also move to the left as viewed in FIG. 12.

The movement of the mounting block 52 is not inhibited by the extend piston 76 because the extend cylinder 74 is maintained at atmospheric pressure since the air vent 198 is now coupled to the lefthand portion of the extend cylinder 74 through the duct 206. As the mounting block 52 moves to the left in FIG. 12 toward its static or ready position as illustrated in FIG. 9 of the drawings, the bit holder 130 and therefore the bit 34 are moved toward the fastener **30*b* as shown in FIG. 8 which has been positioned in the nose assembly 32 in alignment with the bit 34 by the incremental advance of the carrier member 28 of the fastener strip 26 due to the movement of the feed pawl 100**.

The mounting block 52 will proceed to move toward the rear end 122 of the cylinder housing 58 due to the continued supplying of reservoir air to the retract cylinder 92 between the retract piston 86 and the piston seal 88. The mounting block 52 will come to its static or ready position as illustrated in FIG. 9 when the retract piston 86 engages the spacer 210. Prior to the mounting block 52 being positioned as illustrated in FIG. 9 of the drawings, the tip 164 of the bit 34 will engage the head 162 of the fastener 30*b* forcing the fastener 30*b* be removed from the slot in the tab 166 on the carrier member 28 in which the fastener 30*b* is held. The fastener 30*b* is then forced between the nose jaws 174 and 176 until it reaches the position illustrated in connection with the fastener 30*a* in FIG. 6 of the drawings. The bit 34 and the fastener 30*b* will be positioned as shown in FIG. 6 when the mounting block 52 is positioned as shown in FIG. 9 with the retract piston 86 against the spacer 210. At this point in the operation of the feeder and driver assembly 22, the feeder and driver assembly 22 is now in its static or ready position to again be actuated by an operator installing the next screw 30*b* into a workpiece.

Since the fastener driving tool 20 and the feeder and driver mechanism 36 can be operated by pressurized air supplied by a portable compressor or the like, the feeder and driver assembly 22 can be utilized at a construction sight or any other location where a source of pressurized air is available. Moreover, the feeder and driver assembly 22 can be made relatively lightweight and not cumbersome as compared to a mechanism which would require an electric motor or the like to operate the feeder and driver mechanism.

Although the present invention has been described with reference to one preferred embodiment thereof, it will be apparent that other modifications and embodiments can be devised by those skilled in the art which will fall within the spirit and scope of the present invention.

What is claimed and sought to be secured by Letters Patent of the United States is:

1. A fastener feeder and driver apparatus to supply fasteners to be driven into a workpiece, said apparatus comprising:

a power actuated driving tool, a plurality of individual fasteners carried on a flexible carrier means, positioning means for positioning said individual fasteners with respect to said power actuated driving tool so as to be in position to be driven by said power actuated driving tool, feeding means for advancing said carrier strip means so that an individual fastener is supplied to said positioning means, pneumatically operated movement means to move said power driving tool relative to said individual fastener, said power driving tool being supported by said pneumatically operated movement means, and stop means including stop valve means to control said pneumatically operated movement means to limit the movement of said power actuated driving tool relative to said positioning means, said stop means further including stop actuating means affixed to said pneumatically operated movement means to control said stop valve based on the depth to which said individual fastener is driven into said workpiece.

2. The fastener feeder and driver apparatus as set forth in claim 1 wherein said driving tool includes a drive member and a source of pressurized air, wherein said feeding means includes pneumatically controlled feeding means for incrementally advancing said carrier means so as to position said individual fastener in alignment with said drive member so as to be engaged by said drive member, said pneumatically controlled feeding means includes a feed piston which is selectively connected to said source of pressurized air and moves under the influence of presssurized air from said source of pressurized air in a first direction and further includes a pawl piston means which has a pawl to engage said carrier means, wherein said driving tool further includes feeder mechanism means for interconnecting said feed piston and said pawl piston, said feeder mechanism means including a pivot plate having first chain link means attached to said feed piston and having a second chain link means attached to said pawl piston such that said pawl piston moves in a second direction transverse to said first direction in response to the movement of said feed piston, wherein said positioning means includes a nose means including a fastener holding means for holding said individual fastener, and wherein said pneumatically operated movement means moves away from and toward said nose means so that said drive member can engage said individual fastener.

3. The fastener feeder and driver assembly as set forth in claim 2 wherein said pneumatically operated driver means includes pneumatically operated extend means having an extend piston which is movable within an extend cylinder, said extend piston moves with respect to said nose means in response to pressurized air being supplied to said extend cylinder from said source of pressurized air; and pneumatically operated retract means having a retract piston and a retract cylinder, said retract piston moves in response to pressurized air being supplied to said retract cylinder from said source of pressurized air; and further including pneumatic control means to control the supplying of said pressurized air from said source of pressurized air to said retract cylinder and to maintain said extend cylinder at atmosphere pressure so that said pneumatically operated movement means is maintained in a position relative to the nose means during a first mode of said feeder and driver assembly such that said driver member is in engagement with said fastener.

4. The feeder and driver assembly as set forth in claim 3 wherein said pneumatic control means vents said retract cylinder to atmosphere and supplies said extend cylinder with pressurized air from said source of pressurized air in order to move said pneumatically operated movement means away from said nose means during a second mode of said feeder and driver assembly.

5. The fastener feeder and drive assembly as set forth in claim 4 wherein said pneumatic control means vents said extend cylinder to atmosphere and supplies said retract cylinder with pressurized air from said source of pressurized air to move the pneumatically operated movement means towards said nose means during a third mode of said feeder and driver assembly such that said driver member removes said fastener from said carrier means.

6. The fastener feeder and drive assembly as set forth in claim 5 wherein said control means supplies said feed piston with pressurized air from said source of pressurized air during said third mode of said feeder and driver assembly so that said feed pawl engages said carrier means and incrementally advances said carrier means.

7. The feeder and driver assembly as set forth in claim 1 wherein said stop actuating means includes adjustable depth means mounted on said pneumatically operated movement means to control the position of said power actuated driving tool as said individual fastener is driven into said workpiece by said power actuated driving tool.

8. The feeder and driver assembly as set forth in claim 1 wherein said stop valve means moves from a first position wherein said pneumatically operated movement means moves said power actuated driving tool toward said positioning means and to a second position wherein said pneumatically operated movement means moves the power actuated driving tool away from said positioning means.

9. A fastener feeder assembly for use with a fastener driving tool having a fastener driver operable along a predetermined path for driving individual fasteners into a workpiece, said assembly comprising:

a carrier on which said individual fasteners are disposed, a fastener feeding means mounted on said fastener driving tool, said fastener feeding means includes pneumatically controlled feeding means for incrementally advancing said carrier and advances said carrier so that said individual fasteners are sequentially fed into said predetermined path, mechanical fastener retaining means for releasably retaining an individual fastener in said predetermined path, and control means associated with said fastener driving tool and said fastener feeding means for affecting synchronized operation of said fastener driver and said fastener feeding means such that said fastener driver first engages an individual fastener, removes said individual fastener from the mechanical fastener retaining means and drives said individual fastener into the workpiece and thereafter said fastener feeding means advances said carrier so as to dispose another individual fastener in said predetermined path and said fastener driver engages said another individual fastener, removes said another individual fastener from said carrier and places said another individual fastener in said mechanical fastener retaining means, said control means includes pneumatically operated extend and retract means to control the movement of the fastener drive along said predetermined path and further includes adjustable stop means having stop valve means in pneumatic communication with said pneumatically operated extend and retract means for adjustably controlling the movement of said pneumatically operated extend and retract means and stop actuating means affixed relative to said pneumatically operated extend and retract means for actuating said stop valve means based on the depth to which said individual fastener is driven into said workpiece.

10. An assembly for driving fasteners into a workpiece, the fasteners being removably retained on a carrier and having an end portion adapted to engage the workpiece, said assembly comprising:

a fastener driving means including a driver operable along a predetermined path through a driving stroke during which one of said fasteners is driven into the workpiece, a fastener feeding means on said assembly for feeding individual ones of said fasteners in sequence into said predetermined path, mechanical fastener retaining means for releasably retaining one of said fasteners in said predetermined path, and control means coupled to said fastener driving means and said fastener feeding means for effecting synchronized operation of said driver and the fastener feeding means, said control means having cycles of operation, each of said cycles including a first static mode during which said one of said fasteners is releasably retained in said fastener retaining means and said driver is in engagement with said one of said fasteners, a second mode during which said driver removes said one of said fasteners form said fastener retaining means and drives said one of said fasteners into the workpiece and a third mode during which said fastener feeding means feeds an additional fastener into said predetermined path and said driver engages and transfers said additional fastener from said carrier to said fastener retaining means such that said control means is in said first static mode with said driver remaining in engagement with said additional fastener until the next cycle of operation of said control means.

11. The assembly set forth in claim 10 including a housing on which the assembly is carried and at least partially enclosing the carrier and the fastener feeding means, and means mounting the mechanical fastener retaining means on the housing in such a position that said end portion of a fastener releasably retained by said mechanical fastener retaining means extends beyond said housing to permit contact of said workpiece by said end portion.

12. An assembly for driving fasteners removably mounted on a carrier into a workpiece comprising:

a supporting structure, a fastener driving means on the structure movable through a first path to drive a fastener into the workpiece, fastener feeding means on said structure for moving said carrier along a second path intersecting said first path, said fastener feeding means moving said fastener into said first path, retaining means mounted on said structure in said first path and offset from said second path for releasably retaining said fastener to be driven by the fastener driving means as it moves along said first path, and control means for operating said fastener driving means and said fastener feeding means to feed successive fasteners from the carrier and drive said fasteners into the workpiece, said control means including an operating control coupled to said fastener driving means and said fastener feeding means for initiating successive cycles of operation of the fastener driving means and the fastener feeding means, each of which cycles of operation includes a first static mode wherein a fastener placed in said retaining means during a prior cycle of operation is releasably retained in said retaining means, a second mode wherein said fastener driving means drives into the workpiece said fastener and a third mode wherein the fastener feeding means advances the carrier so that said fastener driving means removes another fastener from the carrier and places said another fastener in said retaining means thereby returning said control means to said first static mode for the next cycle of operation.

13. An assembly for driving fasteners into a workpiece, said fasteners being removable from a length of a carrier, said assembly comprising:

a fastener driving means including a fastener driver operable along a predetermined path through a driving stroke during which a fastener is driven into the workpiece, a fastener feeling means coupled to the fastener driving means for feeding individual fasteners from said carrier in sequence into said predetermined path, mechanical fastener retaining means for releasably retaining an individual fastener in said predetermined path, and control means operable between static and actuated states and coupled to the fastener driving means and the fastener feeding means for effecting synchronized operation of the fastener driver and the fastener feeding means, said control means being initially in said static state with a fastener positioned in said fastener retaining means and including means responsive to the actuation of said control means from said static state to said actuated state for effecting in sequence 1) the operation of the fastener driver to remove a fastener from the retaining means and to drive the fastener into the workpiece, 2) the operation of the fastener feeding means to advance an additional fastener into said predetermined path, and 3) the transfer of said additional fastener from the carrier to the fastener retaining means and thereafter responsive to the actuation of said control means to said static state for returning said control means to said static state.

14. An assembly for driving one of a plurality of fasteners mounted on a carrier into a workpiece, each of said fasteners having a free end portion, said assembly comprising:

a housing, a fastener driving means on said housing movable through a given first path to drive a fastener into said workpiece, fastener feeding means on said housing for moving said carrier along a second path extending generally perpendicular to said first path and intersecting said first path to move a fastener into said first path, retaining means mounted on said housing in said first path and offset from said second path for releasably retaining a fastener to be driven by the fastener driving means as it moves along said first path, said retaining means retaining a fastener therein with said free end portion disposed outside of said housing to permit placing said free end portion against the workpiece, and control means including an operating control coupled to the fastener driving means and the fastener feeding means for effecting synchronized operation of the fastener driving means and the fastener feeding means, said control means automatically effecting in response to each operation of the operating control a sequential cycle of operation of the fastener driving means and the fastener feeding means, said sequential cycle of operation including (1) the removal of a fastener from the retaining means and the driving of said fastener into the workpiece, said fastener having been releasably retained in a static mode in said retaining means from said prior cycle of operation, (2) the advancement of the carrier to place another fastener in said first path, and (3) the removal of said another fastener from the carrier and the placement of said another fastener in said retaining means with its free end portion disposed outside of said housing, said another fastener remaining in said retaining means in said static mode until another subsequent cycle of operation is initiated.

* * * * *